United States Patent [19]

Bes

[11] 4,390,034

[45] Jun. 28, 1983

[54] UNCLOGGING AND RECOVERING DEVICE FOR SLUDGE DEPOSITED ON THE TUBE PLATE OF A STEAM GENERATOR

[75] Inventor: Louis Bes, Noisy-le-Grand, France

[73] Assignee: Framatome, Courbevoie, France

[21] Appl. No.: 279,284

[22] Filed: Jun. 30, 1981

[30] Foreign Application Priority Data

Jul. 18, 1980 [FR] France ..... 80 15901

[51] Int. Cl.[3] ..... B08B 3/02; B08B 9/02

[52] U.S. Cl. ..... 134/104; 134/105; 134/167 C

[58] Field of Search ..... 134/104–105, 134/166 C, 167 C

[56] References Cited

U.S. PATENT DOCUMENTS

| | | | |
|---|---|---|---|
| 1,608,030 | 11/1926 | Miller, Sr. | 134/104 X |
| 2,652,737 | 9/1953 | Longstreet | 134/104 X |
| 3,393,689 | 7/1968 | Faler | 134/104 |
| 3,426,774 | 2/1969 | Conn | 134/166 C |
| 3,623,910 | 11/1969 | Calhoun et al. | 134/104 X |
| 3,938,535 | 2/1976 | Cradeur et al. | 134/167 C |
| 4,209,028 | 6/1980 | Shenker | 134/167 C X |
| 4,333,910 | 6/1982 | Lorrek et al. | 134/104 X |

*Primary Examiner*—Robert L. Bleutge

*Attorney, Agent, or Firm*—Pollock, Vande Sande & Priddy

[57] ABSTRACT

The device comprises a ramp for dislodging sludge by high pressure jets fixed permanently inside a steam generator, horizontally and above the tube plate. The ramp is supplied with water under pressure through a movable distributor. The device also includes means for driving the sludge towards the center of the plate and a discharge valve for the sludge arranged above an orifice passing through the tube plate at its central part and opening into the hollow central column. The invention is particularly useful for steam generators of pressurized water nuclear reactors.

7 Claims, 6 Drawing Figures

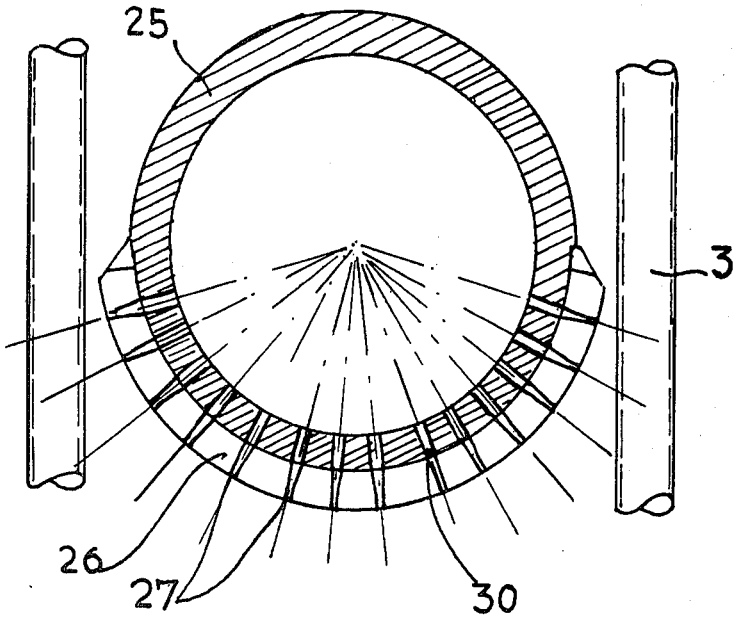
Fig 4
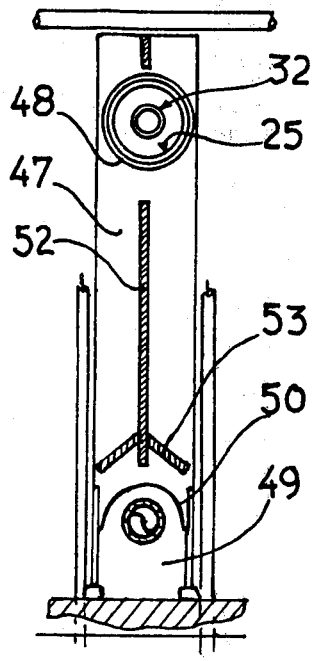
Fig 5
Fig 6
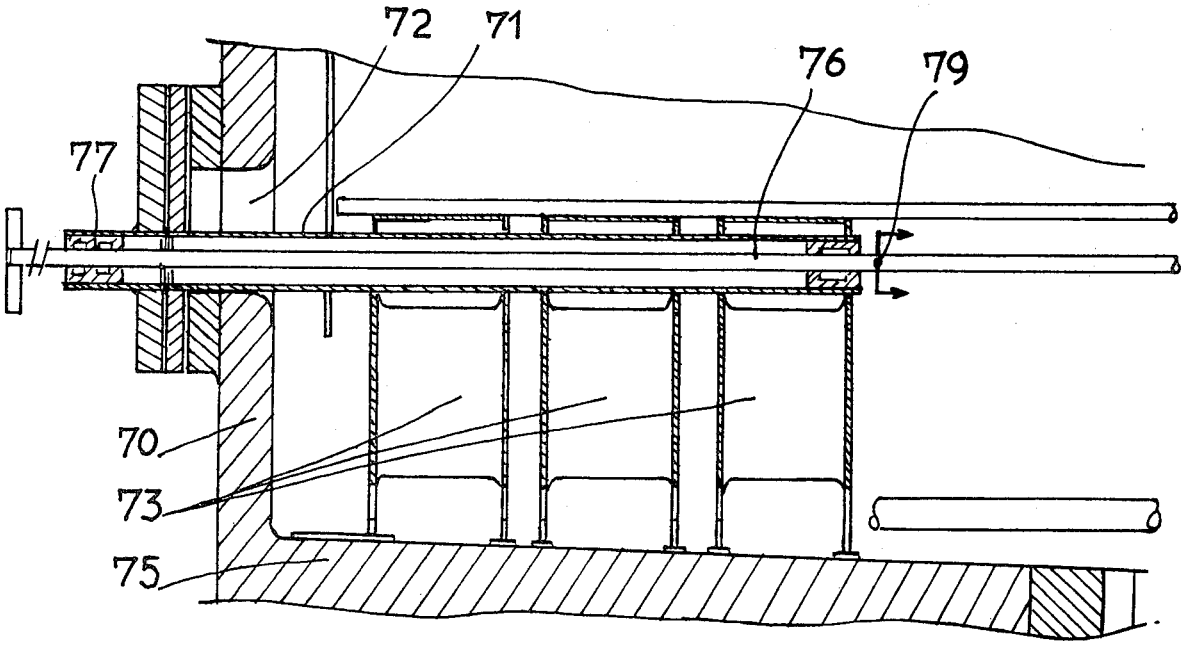

UNCLOGGING AND RECOVERING DEVICE FOR SLUDGE DEPOSITED ON THE TUBE PLATE OF A STEAM GENERATOR

FIELD OF THE INVENTION

The invention relates to a device for unclogging and recovering sludge deposited on the tube plate of a steam generator.

BACKGROUND OF THE INVENTION

The steam generators of pressurized water nuclear reactors generally include a cylindrical jacket of great height within which a bundle composed of a large number of tubes of small diameter bent into a U is arranged vertically.

Each of the tubes of the bundle is connected through one of its two ends to a tube plate arranged horizontally in the vicinity of the lower part of the steam generator, above the domed lower base of this generator.

The lower part of the steam generator situated beneath the tube plate is partitioned into two substantially identical compartments, of which one communicates with one of the ends of all the tubes of the bundle, and the other communicates with the other ends of these tubes. The water under pressure bringing the heat from the core of the nuclear reactor to the steam generator for the vaporization of the supply water is introduced into one of the compartments, flows in the tubes of the bundle, and comes back into the second compartment; this water under pressure which has yielded a portion of its heat for the vaporization of the feed water is returned to the core of the nuclear reactor.

The group of arms of the U-tubes communicating with the pressurized water inlet compartment constitutes the hot branch of the bundle of tubes, while the group of arms of U-tubes communicating with the other compartment constitutes the cold branch. Between the hot branch and the cold branch of the bundle there usually exists a free space of a certain width.

The supply water to be vaporized is introduced into the upper part of the steam generator and comes into contact with the tube bundle traversed by the pressurized water at high temperature, which causes the progressive vaporization of the feed water.

The steam produced is led off at the upper part of the steam generator and sent to the turbine associated with the electrical generator.

The presence of feed water in the steam generator causes, during the operation of the latter for long periods, the formation of deposits of sludge which accumulate on the tube plate around the U-tubes whose ends are fixed by rolling expansion and welding to this plate. This sludge is composed principally of iron oxide and in particular of magnetite. These deposits are the cause of corrosion phenomena of the tubes at the level of the tube plate, and it is hence necessary to remove them to avoid more or less rapid deterioration of the steam generator.

It has been proposed, for example, to arrange drainage tapping ramps at the level of the tube plate of the steam generator in the space existing between the hot branch and the cold branch of the bundle.

Such ramps permit a part of the sludge which can accumulate on the tube plate to be removed during the operation of the steam generator, but a portion of the impurities transported by the feed water is nonetheless deposited at places where the tubes are joined to the tube plate.

Devices have therefore been proposed enabling the tube plate to be unclogged during shut-offs reserved for the maintenance of the steam generator.

For example, it has been proposed to introduce through a hole provided in the enclosure of the steam generator, immediately above the tube plate, a lance enabling water jets to be sent under very high pressure tangentially to the tube plates. This lance is moved tangentially until it reaches the center of the tube plate where it has passed slightly beyond the center of this plate.

In a second phase, the lance is introduced through another opening placed in a diametrically opposite position from that of the first opening to clean the second half of the tube plate.

During the whole of this unclogging operation a flow of water is provided on the tube plate, which permits the draining of the loosened sludge, through purging orifices.

This device however, has drawbacks since it is not usable during operation, and thus corrosion-inducing deposits remain within the junction zone between the tubes and the tube plate for a length of time which is not negligeable, namely, between successive maintenance operations.

On the other hand, the time required for the cleaning of the tube plate is very long since it must carry out successively, in moving the lance from the inside of the steam generator, the cleaning of the two halves of the tube plate.

There exist various types of devices enabling cleaning liquid to be collected and the sludge to be detached from the tube plate. For example, there is known a ramp of annular shape arranged at the periphery of the tube plate collecting the sludge during the operations of cleaning the tube plate.

These devices do not however, give complete satisfaction for the complete removal of the sludge freed by the water jets, and it is difficult to assure thorough cleaning of the tube plate.

In other respects, steam generators have already been manufactured including a hollow central support column for the tube plate arranged between the lower surface of the latter and the domed lower end of this generator.

It has never, however been conceived to use this hollow central column for the removal of disengaged sludge from the tube plate of the steam generator.

OBJECTS OF THE INVENTION

It is therefore an object of the invention to provide a device for unclogging and recovering sludge deposited on the tube plate of a steam generator comprising, in a cylindrical vessel with a vertical axis, a vertical bundle of tubes bent into a U, each connected at one of their lower ends to a horizonatal tube plate fast to the vessel of the steam generator supported at its central part by a vertical hollow column fast to the lower base of the steam generator, a fluid at high temperature being brought to the tubes of the bundle beneath the tube plate, to provide the heat permitting the vaporization of the feed water introduced into the upper part of the steam generator in contact with the tubes of the bundle, this feed water causing the deposition of sludge on the tube plate, and the unclogging device enabling the sludge deposited on the tube plate to be rapidly removed, whether or not the steam generator is in operation.

SUMMARY OF THE INVENTION

For this purpose, the device for unclogging and recovering sludge according to the invention comprises:

a ramp for unclogging by high pressure jets fixed permanently to the inside of the steam generator, horizontally and above the tube plate, in a diametric direction of the latter, supplied with water under pressure through a distributor movable inside the ramp, in the longitudinal direction of the latter, for the constitution of the high pressure jets, directed towards the tube plate, successively at different places along the length of the ramp, means for driving towards the center of the tube plate sludge which is formed during the operation and which is stirred by the water jets and, a discharge valve for the sludge arranged above an orifice passing through the tube plate at its central part and opening into the hollow central column.

In order that the invention may be better understood, two embodiments of a device for unclogging and recovering sludge associated with a pressurized water nuclear reactor steam generator will now be described by way of non-limiting examples, with reference to the accompanying drawings.

BRIEF DESCRIPTION OF THE DRAWINGS

In the drawings:

FIG. 4 is a sectional view on an enlarged scale along the line B—B of FIG. 1.

FIG. 5 is a view along the line C—C of FIG. 1.

FIG. 6 is half-view in section through a plane of symmetry at the level of the tube plate of a steam generator equipped with a second embodiment of an unclogging device according to the invention.

DETAILED DESCRIPTION

Figure 1:
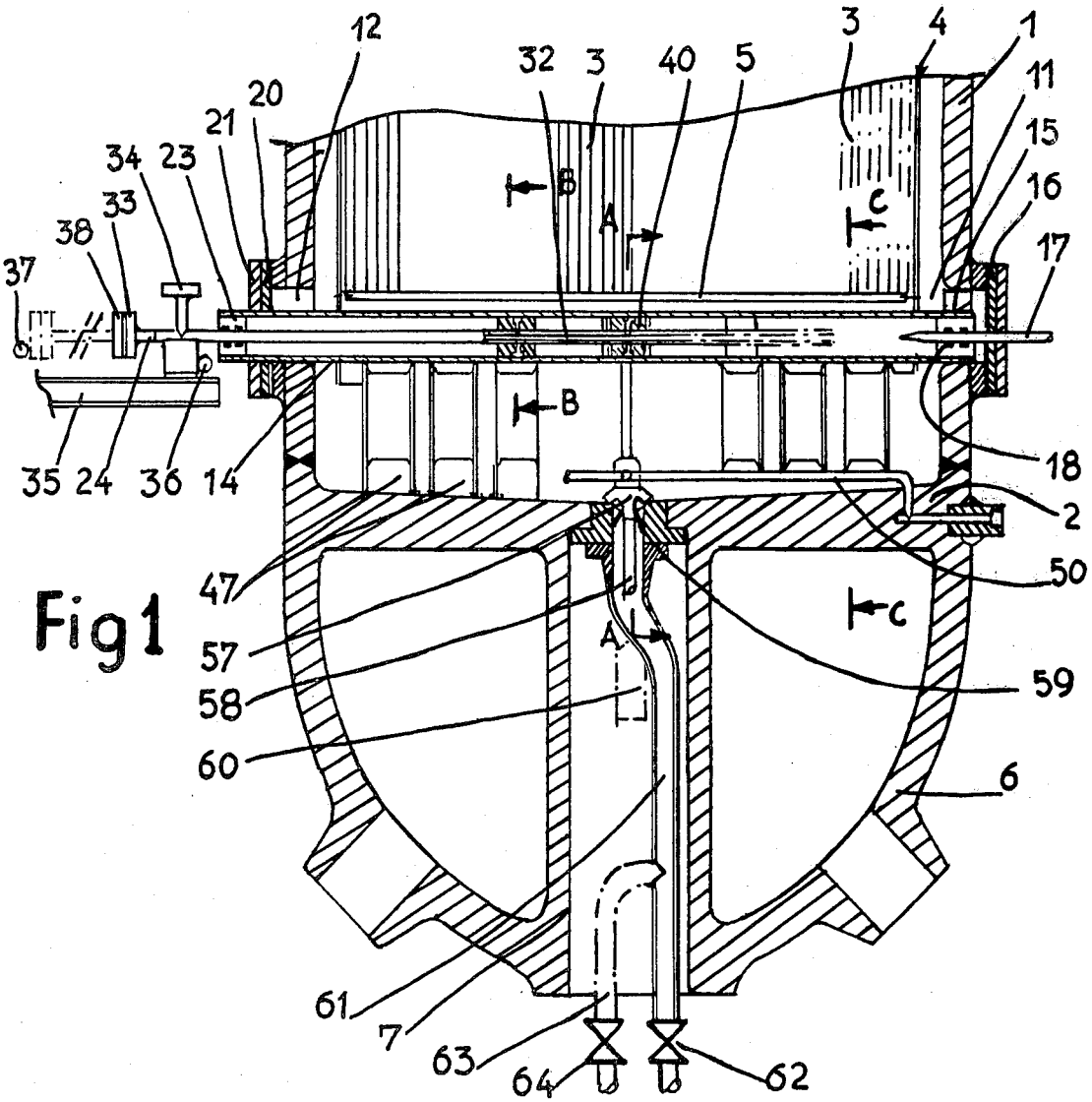
FIG. 1 shows a sectional view through a vertical plane of symmetry of the lower part of the steam generator in which is to be seen the device for unclogging and recovering sludge.

FIG. 1 shows the lower part of the vessel 1 of a steam generator comprising a tube plate of considerable thickness 2 within which are fixed by rolling expansion and welding, tubes 3 bent into a U at their upper part (not shown), constituting a vertical bundle with a hot branch, and a cold branch leaving an empty space at the central part of the steam generator, in the vicinity of the diametric plane constituting the plane of section of FIG. 1.

For convenience of illustration, the lower part of the tubes penetrating into the tube plate has not been shown.

The whole of the bundle is enclosed in a jacket 4 and held in position in the transverse directions by a distributing plate 5 pierced with holes for the passage of the tubes and by cross-braced plates (not shown).

The domed lower end of the tank 6 comprises a central chimney 7 connected to the tube plate 2 at its central part.

In extension of the chimney 7, the tube plate 2 is pierced by an opening 9 opening on one side into the chimney 7, and on the other at the upper level of the tube plates 2.

The tube plate comprises an upper surface machined as a tray whose lowest point is at the center of the plate.

A little above the tube plate and below the distributing plate 5, the wall of the steam generator is pierced by two apertures 11 and 12 enabling the passage of the high pressure jet unclogging ramp 14.

One of the ends of the ramp 41 constituted by a tube is engaged in the aperture 11 and held in place inside this aperture by a part 15 which permits translation movements of this end with respect to the wall of the steam generator on expansion of the tubular ramp.

The aperture 11 is closed by a closing and sealing unit 16 traversed in fluid-tight manner by a pipe 17 centered inside the ramp 14 by a centering part 18, this pipe 17 permitting the delivery of water into the ramp for its cleaning.

The other end of the ramp 14 which traverses the aperture 12 is fast to the central plate 20 of a unit 21 for closing and sealing the aperture 12, so that this end of the ramp 14 is fixed in translation with respect to the steam generator, a screw assembly enabling the fastening of the device 21 and of the plate 20 with respect to the wall of the steam generator.

Through this fixed end of the tube ramp 14 penetrates into this ramp, through a double fluid-tight seal 23, an assembly 24 enabling high pressure water to be led into the ramp 14.

Figure 3:
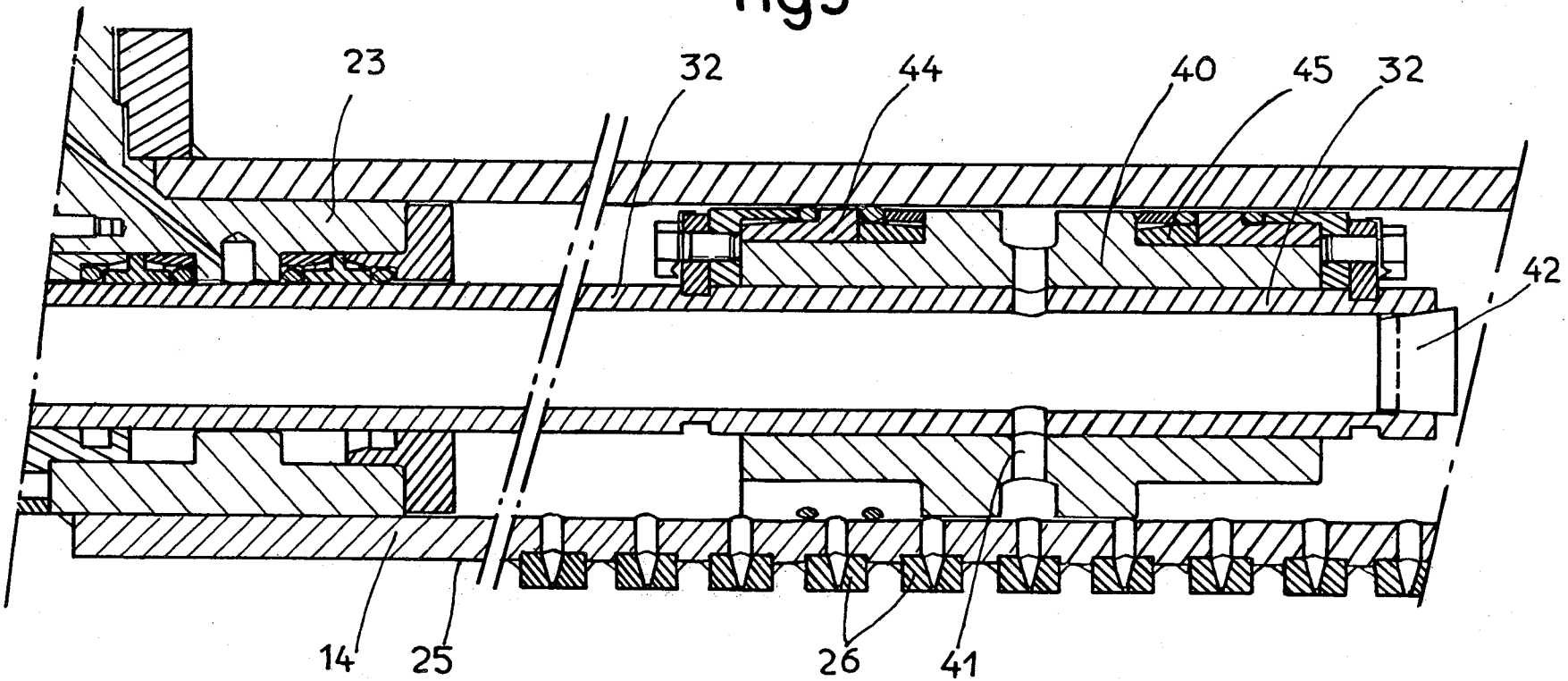
FIG. 3 is a view in section through a plane of symmetry of a part of the high pressure jet unclogging ramp.

The sprinkling ramp, as is seen in FIGS. 3 and 4, is constituted by a tube 25 on which are fixed by welding ring portions 26 pierced by profiled and calibrated holes 27 arranged in extension of the corresponding holes 28 traversing the wall of the tube 25.

This set of calibrated and profiled holes constitutes the nozzles 30 receiving water under pressure, enabling the unclogging in the manner which will be indicated below.

Figure 2:
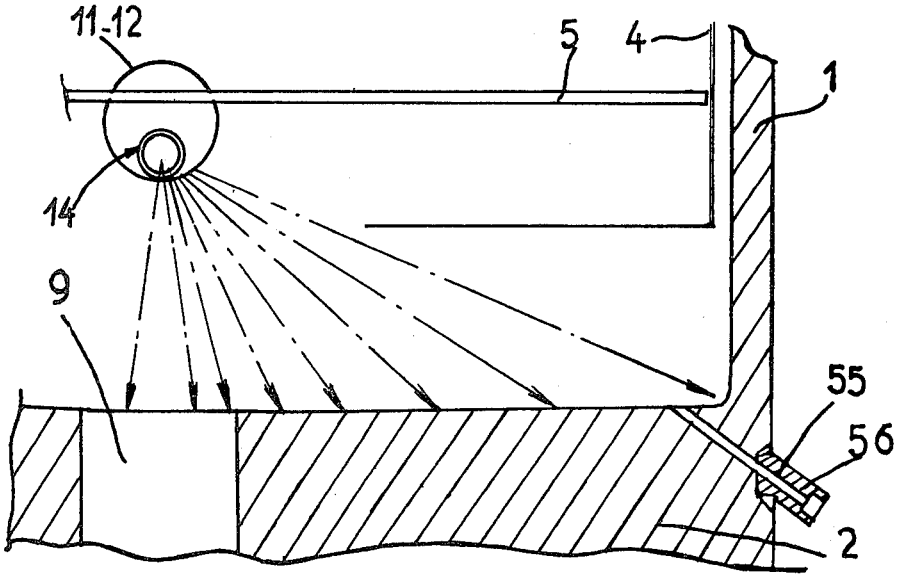
FIG. 2 is a simplified half-view in section along the line A—A of FIG. 1.

The set of nozzles pierced to the inside of a ring portion 26 constitutes a set of nozzles 30 which thus enable (as shown in FIGS. 2 and 4) the angular orientation of the pressurized water jets, so that the latter reach points of the tube plate located over the whole length of a chord of the latter.

The ring portions 26 being arranged over a certain length of the tube 25 in its central part and regularly spaced in the longitudinal direction of this tube 25, the various sets of nozzles associated with each of the rings 26 permit the unclogging of the whole central part of the tube plate 2 on which is deposited the sludge brought in by the feed water introduced into the steam generator at the periphery of the envelope 4 in the annular space separating the vessel 1 of the steam generator, from the envelope 4.

The peripheral part of the plate which is swept by the supply water arriving at a certain speed is practically free of dirty deposits, even after prolonged use of the steam generator.

In FIGS. 2 and 4 it is seen that each of the sets of nozzles arranged on the tube ramp 14 comprises fourteen nozzles distributed regularly over a portion of the surface of the tube ramp.

Each of the sets of nozzles arranged on the ramp 14 is placed in the interstice formed between two successive tubes 3 of the bundle constituting the steam generator.

Referring to FIGS. 1 and 3, it is seen that the device 24 for feeding the ramp 24 with water under pressure is constituted by a tube 32 mounted in fluid-tight manner in the tube 25 by means of a double seal 23 constituting a fluid-tight sliding passage enabling movements of the tube 32 inside the tube ramp 14.

The tube 32 is connected at one of its ends both to two flanges 33 and 34 to a jack 35 enabling step-by-step movement of the device 24 in either direction axially of the ramp, with an amplitude of movement between each step equal to the distance separating two sets of nozzles 30.

The jack 35 is a push chain jack actuated by a motor-brake unit through a speed reducing unit. The driving device can also be clutched, which permits manual intervention on the displacement actuation of the device 24.

Stroke-end contacts 36 and 37 enable the course of the jack to be stopped when the device 24 is at the end of its rearward or forward movement, respectively.

The flange 33 is closed by a closing and sealing plate, 38 while the flange 34 is connected to a pressurized water feed device (not shown) including a flexible feed pipe enabling the movements of the device 24 to be followed.

At its end opposite the end connected to the flanges 33 and 34 and to the jack 35' the tube 32 is connected to a distributing slide valve 40 whose construction is seen in FIG. 3.

This distributing slide valve 40 is constituted by a sleeve traversed by apertures 41 whose number and position correspond to the total cross-section of the holes 28 pierced in the corresponding section of the tube 25.

The tube 32 itself also includes apertures extending the apertures 41 and a closure plug 42 at its end situated at the level of the slide valve 40.

On the sleeve constituting the body of the distributor 40 are mounted two sealing devices 44 and 45 encircling the set of apertures 41.

These sealing devices enable the translation of the distributing slide valve inside the tube 25 so that the aperture jets 41 are successively placed in register with the sets of nozzles 30 arranged along the ramp 14, on the stepwise movement of the device 24 inside the ramp.

In this manner the pressurized water is sent successively into each of the sets of nozzles for the unclogging of the points of the tube plate of the steam generator positioned on successive chords of this tube plate.

Thus, as shown in FIGS. 1 and 5, profiled parts 47 are fixed one after the other on the tube plate 2, at its central part between the cold branch and the hot branch of the tube bundle 3, and include at their upper part a circular aperture 48 enabling the passage of the ramp 14 of which the profiled elements 47 assure the support.

An aperture 49 is also formed in the lower part of the central support parts 47 for the passage of the purging tube 50 enabling the permanent removal of the suspended sludge and the sampling of the secondary water from the steam generator. The central part 52 of the profiled element bears on the other hand deflectors 53 preventing the accidental reascent of the sludge-charged water on the declogging and draining of the water to the center of the plate.

The set of profiled elements 47 constitutes, on the other hand, filling elements for the space devoid of tubes between the two parts of the bundle, between the distributing plate 5 and the tube plate 2. This arrangement facilitates the cleaning of the two tube half-plates arranged on either side of this space.

As shown in FIG. 2, apertures such as 55 are formed through the tube plate so as to permit the introduction of drainage water at the periphery of the tube plate by means of an end fitting 56 on which it is possible to fix a drainage water supply pipe.

The inclined bowl shape of the tube plate and the provision of these water inlets at the periphery of the plate facilitates the flow of the sludge to the center of the tube plate, i.e., towards the aperture 9 passing through the tube plate.

This aperture 9 can be closed by a valve 57 whose closure element comes to rest on a seat fixed at the center of the tube plate. The seal-bearing surface of the closure element 57 is coated with a very hard metal, so that any solid debris becoming lodged at the level of the aperture 9 of the tube plate can be crushed under the effect of the pressure which tends to thrust the closure element 57 onto its seat.

The closure element 57 is fast to a control rod 58 manipulable by means of a jack 60 which enables the element 57 to be lifted above the aperture 59.

If the closure element 57 is covered by a crust of sludge deposited by the feed water at the center of the plate, this crust must be broken at the time of lifting the closure element 57 by means of the rod 58 and of the jack 60.

A discharge pipe 61 passing inside the hollow central column 7 extends the aperture 9 of the tube plate and permits the removal of debris in the form of sludge flowing through the aperture 9 on the lifting of the closure part 57.

The pipe 61 is closed by a direct passage valve connected to a sludge processing plant.

A second pipe 63 is branched onto the pipe 61 and enables the possible introduction of water into the discharge pipe 61 through the valve 64.

A summary description will now be given of the operation of the sludge unclogging and recovery device according to the invention, with reference to all of the figures.

In normal operation of the steam generator, the deposits take place in the central zone of the tube plate where the horizontal flow speeds are low. To remove these deposits, the valve 57 is manipulated, and simultaneously the nozzles of the ramp 14 are supplied by means of the distributor fed with high pressure water and moved step by step between the various sets of nozzles 30 from an end position of this distributor (front or rear) to the position at the center of the tube plate. The distributor can then be brought back to the other end position to carry out the sweeping of the tube plate up to its central part again in the direction from the periphery to the center.

The water injection can be maintained or arrested during the duration of the translation movement of the distributor slide valve.

It is also possible to proceed with successive return trips over the whole length of the path of the distributor in order to facilitate the mixing of the liquid phase and of the sludge deposited on the tube plate.

It is also possible to carry out sequences of pressurized water injection through the ramp 14 followed by opening and closing movements of the valve 57.

The jets of water under high pressure accomplish the unclogging of the tube plate and the suspension of the debris in the sludge-removing water, so that the fluidized sludge which results therefrom can flow towards the center of the plate due to the inclination of this bowl-shaped plate and possibly due to the injection of drainage water through the periphery of the plate by means of the pipes 55, 56.

When the whole of the sludge has been removed, the valve 57 is closed and it is possible to stop the injection of water through the ramp 14.

FIG. 6 shows another embodiment of the unclogging ramp according to the invention, this ramp being constituted by two guide-tube portions fixed in the wall 70 of the steam generator, one of these guide tubes 71 being fixed in the wall 70 of the steam generator at the level of an aperture 72, and another portion of guide tube being situated in an aperture of the wall 70 of the steam generator diametrically opposite the aperture 72.

The guide tubes such as 71 are on the other hand supported within the steam generator by a set of sectional elements 73 resting on the tube plate 75 of the steam generator.

A distributor 76 constituted by a very long tube is on the other hand mounted slidably and rotatably inside the guide tube 71 by means of stuffing boxes such as 77.

A drive device enables the tubular distributor 76 to effect a translation movement in the direction on the guide tubes, i.e., in the diametric direction of the tube plate and a rotary movement of limited amplitude enabling one or several nozzles 79 fast to the part of the tube 76 which remains constantly outside the guide tube to be directed towards the various parts of the central zone of the tube plate.

The tube 76 is supplied with water under pressure and, in the course of its movement by translation and rotation, this distributor tube 76 permits sweeping of the central zone of the tube plate where the sludge deposits occur.

It will be understood that such a device is quite equivalent to the device which has been described with reference to FIGS. 1 to 5.

It will be seen that the principal advantages of the device according to the invention are to permit rapid unclogging and removal of the sludge deposited on the tube plate of the steam generator, and to permit this operation to be carried out even when the steam generator is functioning.

On the other hand, this operation can be carried out whatever the crust formed at the central part of the tube plate, since this hardened crust of sludge can be destroyed by lifting the central valve.

Finally, the draining of the sludge suspended in the cleaning water permits rapid and positive removal of this sludge at the center of the plate.

The invention is not limited to the embodiment which has just been described; it encompasses all modifications.

Thus the high pressure jet unclogging ramp can be held above the plate by means other than profiled elements such as those which have been described; the distributor can be moved in this unclogging ramp differently from the manner which has been described; and the valve for removing the sludge at the center of the plate can be actuated differential from that which has been described.

The nozzles arranged along the ramp can be of any number in each set, provided that these nozzles permit a large part of the tube plate whereon the sludge is deposited to be reached.

The unclogging ramp can be entirely dismountable so that it is possible to effect the maintenance thereof at the time of shutdown of the power station and to proceed if necessary with unclogging by jets under pressure by introducing a lance movable through the insertion holes of the ramp.

The invention can be applied to any steam generator constituted by a vertical tube bundle arranged inside an enclosure, whether the tube bundle is in square or triangular sets, provided that the tube plate is supported at its central part by a hollow column.

I claim:

1. Device for unclogging and recovering sludge deposited on the tube plate of a steam generator comprising, in a cylindrical vessel with a vertical axis, a vertical bundle of tubes bent into a U connected at each of their lower ends to a horizontal tube plate fast to the vessel of said steam generator and supported at its central part by a vertical hollow column fast to the lower end of said steam generator, a high temperature fluid being brought to the tubes of said bundle beneath said tube plate, to provide the heat enabling vaporization of the feedwater introduced into the upper part of said steam generator in contact with the tubes of said bundle, this feed water causing the deposit of sludge on said tube plate, said device comprising:

(a) a ramp for unclogging by high pressure jets fixed permanently to the inside of said steam generator horizontally and above said tube plate, in a direction diametric to the latter, supplied with water under pressure through a distributor movable inside said ramp in the longitudinal direction of the latter, for the constitution of high pressure jets directed towards said tube plate, at different places according to the length of said ramp;

(b) means for driving towards the center of said tube plate sludge which is formed during operation and which is stirred up by said water jets; and (c) a discharge valve for the sludge arranged above an orifice passing through said tube plate at its central part and opening into said hollow central column.

2. Unclogging device according to claim 1, wherein said high pressure jet unclogging ramp is of tubular shape and comprises a plurality of sets of nozzles directed towards said tube plate, arranged at different places according to the length of said ramp, at the level of insterstices of said bundle of tubes and supplied with water under pressure through a distributor movable inside said ramp for the successive supply of each of said sets of nozzles.

3. Unclogging device according to claim 1, wherein said high pressure jet unclogging ramp is constituted by two portions of fixed guide tubes arranged in extension of one another along a diameter of said tube plate within which is mounted movably in axial translation and in rotation a movable tube distributor comprising at least one nozzle of radial direction with respect to said tube distributor, in its part remaining constantly outside of the guide tubes.

4. Unclogging device according to any one of claims 1, 2 and 3, wherein the means for driving sludge towards the center of the tube plate are constituted by water inlet pipes at the periphery and at the level of the upper surface of the tube plate.

5. Unclogging device according to any one of claims 1, 2 and 3, wherein the means for driving the sludge towards the center of the tube plate are constituted by water inlet pipes at the periphery and at the level of the upper surface of the tube plate, and wherein the tube plate is bowl-shaped, and wherein the discharge valve and the orifice, passing through the tube plate are arranged at the lowest part of the top surface of the tube plate corresponding to its central part.

6. Unclogging device according to any one of claims 1, 2 and 3, wherein the discharge valve for the sludge is constituted by an obturator resting on a seat formed in said tube plate by a seal bearing surface of great hardness fast to an operating rod actuatable by lifting means for the opening of said valve.

7. Unclogging device according to any one of claims 1, 2 and 3, wherein said high pressure jet unclogging ramp is supported by a group of angle irons resting on said tube plate.

* * * * *